US005102056A

United States Patent [19]

Ober

[11] Patent Number: 5,102,056

[45] Date of Patent: * Apr. 7, 1992

[54] COMBINATION LEAF AND LAWN DEBRIS COMMINUTING VACUUM AND WOOD CHIPPER

[75] Inventor: Howard R. Ober, Chagrin Falls, Ohio

[73] Assignee: Schiller-Pfeiffer, Inc., South Hampton, Pa.

[ * ] Notice: The portion of the term of this patent subsequent to Aug. 28, 2007 has been disclaimed.

[21] Appl. No.: 572,489

[22] Filed: Aug. 23, 1990

Related U.S. Application Data

[63] Continuation-in-part of Ser. No. 385,945, Jul. 25, 1989, Pat. No. 4,951,882, and a continuation-in-part of Ser. No. 326,630, Mar. 21, 1989, abandoned.

[51] Int. Cl.[5] ..... B02C 13/04

[52] U.S. Cl. ..... 241/55; 241/92; 241/100; 241/101.7; 241/154; 241/190

[58] Field of Search ..... 241/152 R, 92, 282.1, 241/224, 282.2, 243, 101.7, 190, 101 D, 55, 189 R, 56, 73, 100, 101.4, 154

[56] References Cited

U.S. PATENT DOCUMENTS

| | | | |
|---|---|---|---|
| 2,658,318 | 10/1953 | Miller . | |
| 3,049,857 | 8/1962 | Shaw . | |
| 3,688,479 | 9/1972 | Martinson . | |
| 3,712,353 | 1/1972 | Ferry . | |
| 3,817,462 | 6/1974 | Hamlin . | |
| 4,117,983 | 10/1978 | Browning . | |
| 4,325,163 | 4/1982 | Mattson . | |
| 4,360,166 | 11/1982 | Biersack . | |
| 4,463,907 | 8/1984 | Biersack . | |
| 4,773,601 | 9/1988 | Urich . | |
| 4,951,882 | 8/1990 | Ober | 241/101.7 X |

FOREIGN PATENT DOCUMENTS

| | | |
|---|---|---|
| 3042950 | 7/1982 | Fed. Rep. of Germany . |
| 3233454 | 3/1984 | Fed. Rep. of Germany . |
| 3503904 | 10/1985 | Fed. Rep. of Germany . |
| 643156 | 5/1984 | Switzerland . |

*Primary Examiner*—Mark Rosenbaum

*Attorney, Agent, or Firm*—Oldham, Oldham & Wilson, Co.

[57] ABSTRACT

A multipurpose reducer vacuum for vacuuming leaf, garden and lawn debris which uses circular grate bars and free swinging hammers to comminute the debris. The reducer vacuum mounts to the rear bumper of a pickup truck. An adjustable discharge chute is used to direct the comminuted debris into the bed of the pickup truck. A wood chipper is provided on the back side of the apparatus for chipping small limb and branches. An alternate configuration adds an intake hopper which uses a baffle plate in cooperation with cutting bars to pull small limbs, branches and saplings into the reducer vacuum. Feed rates up to one foot per second can be achieved.

27 Claims, 6 Drawing Sheets

COMBINATION LEAF AND LAWN DEBRIS COMMINUTING VACUUM AND WOOD CHIPPER

This application is a continuation-in-part application of application Ser. No. 07/385,945, filed July 25, 1989, now U.S. Pat. No. 4,951,882 and a continuation-in-part of application Ser. No. 07/326,630, filed Mar. 21, 1989, which was abandoned.

FIELD OF INVENTION

This invention relates to leaf, lawn and garden debris disposal. More particularly, it relates to a multipurpose apparatus that fulfills the requirements of three separate machines, a lawn vacuum, a debris comminutor and a wood chipper.

BACKGROUND OF THE INVENTION

The problem of leaf disposal has changed over the past several decades. Previously, leaves and other organic lawn and garden debris such as tree limbs and branches were raked by hand, collected and burned in an open pile. As concerns over clear air increased, open burning of lawn and garden debris was banned.

Leaf, garden and lawn debris was then collected in piles and allowed to decompose or was hauled or taken to landfills for burying. Decomposition of intact leaves is slow and may take several years before the material has completely decayed. For the last few decades, the burial of leaves and lawn debris has been an effective disposal method. In recent years as environmental concerns about landfills has increased, the cost of burying trash, garbage, and debris has escalated. The availability of landfills has become limited. Landfill disposal rates have been increasing. In some areas, local disposal costs have increased from $3 to $5 a load to $28 to $35 a load.

Many devices have been created to deal with the problem of leaf, garden and lawn debris. Several are vacuum and pulverizing devices such as U.S. Pat. Nos. 2,658,318, 3,049,857, 3,668,479 and 3,712,353. Others are only vacuums such as U.S. Pat. No. 4,325,163 or are only wood or limb chippers U.S. Pat. No. 3,384,311. None of these prior art devices have vacuumed up the leaf, garden and lawn debris, shredded the leaves and also chipped the lawn debris such as limbs and branches.

U.S. Pat. No. 4,360,166 to Biersack discloses a motor-driven shredding apparatus with an inlet provided for lightweight garden waste and a second inlet for twigs, branches and the like. The inlet provided for lightweight garden waste has an essentially vertical orientation and utilizes natural gravitational forces to move the debris shredded by shredding blades through the device wherein it is expelled by stamped lugs. A plurality of counter plates are vertically oriented on the inner surface of the chute to prevent the lightweight debris from being rotated around the chute so that it can be shredded by the shredding blades. The shredding blades are positioned essentially parallel to the hypotenuse of the triangular counter plates and shredding occurs between these surfaces. The trailing edge of the counter plates is positioned generally below the cutting area of the shredding blades. No cooperation between shredding blades and counter plates is present to pull or effect movement toward the subsequent counter plate.

The second inlet receives small twigs or branches for chipping as illustrated in FIG. 5. In column 5 beginning at line 1, Biersack teaches that his invention is designed only to chip pieces of thick branch material. The counter plates as shown in FIG. 6 cooperate with the cutter plate merely to chip the material. Therefore, it is clear that the counter plates were provided as stationary cutting surfaces and do not aid in pulling the material through the device.

SUMMARY OF THE INVENTION

The present invention is a multipurpose machine that will vacuum leaf, garden and lawn debris, shred the leaf, garden and lawn debris and chip limbs and branches.

The preferred embodiment of the present invention is gasoline engine driven device that mounts to the bumper of a pickup truck. All of the operative components of the vacuum, reduces, chipper apparatus are mounted on one flywheel. A plurality of fan blades are located around the periphery of the flywheel. These fan blades provide the suction to vacuum leaf, garden and lawn debris through a vacuum hose into a reducing chamber.

Volume reduction is accomplished by a plurality of free swinging hammer bars which extend into a plurality of circular grate bars. The leaf, garden and lawn debris must pass through the circular grate bars where it is comminuted by the free swinging hammers. After being comminuted, the pulverized leaf, garden and lawn debris is blown out a discharge chute and into the bed of the pickup truck.

A chipping blade is located on the reverse side of the flywheel in conjunction with a guide chute on the rear of the housing. Limbs and branches (up to three inches in diameter) which are too large to be vacuumed into the reducing chamber can be manually reduced to chips using the chipping blade. The wood chips enter the exhaust chamber where the fan blades cause them to be expelled into the bed of the pickup truck.

The reducer vacuum achieves a volume reduction of about 75%. This can eliminate three of every four trips to the landfill. Not only does the owner save money with reduced disposal fees, the volume of leaf, garden and lawn debris being disposed is less which reduces the demand on the landfills. Rather than dispose of the reduced debris by landfill burying, the reduced debris can be used as mulch and wood chips. This converts a waste product into a valuable resource.

An alternative configuration adds a feeder intake chute which is designed to pull small limbs, branches and saplings into the reducing chamber. The shape and length of the small limbs, branches and saplings prevent them from being vacuumed through a vacuum hose.

The intake chute has two major components inside the chute. A baffle plate is located just before two rotating blades. The baffle plate prevents the incoming material from rotating when grabbed by the two rotating blades. These rotating blades grab the incoming material and move it into the reducer vacuum.

DETAILED DESCRIPTION OF THE INVENTION

Figure 1:
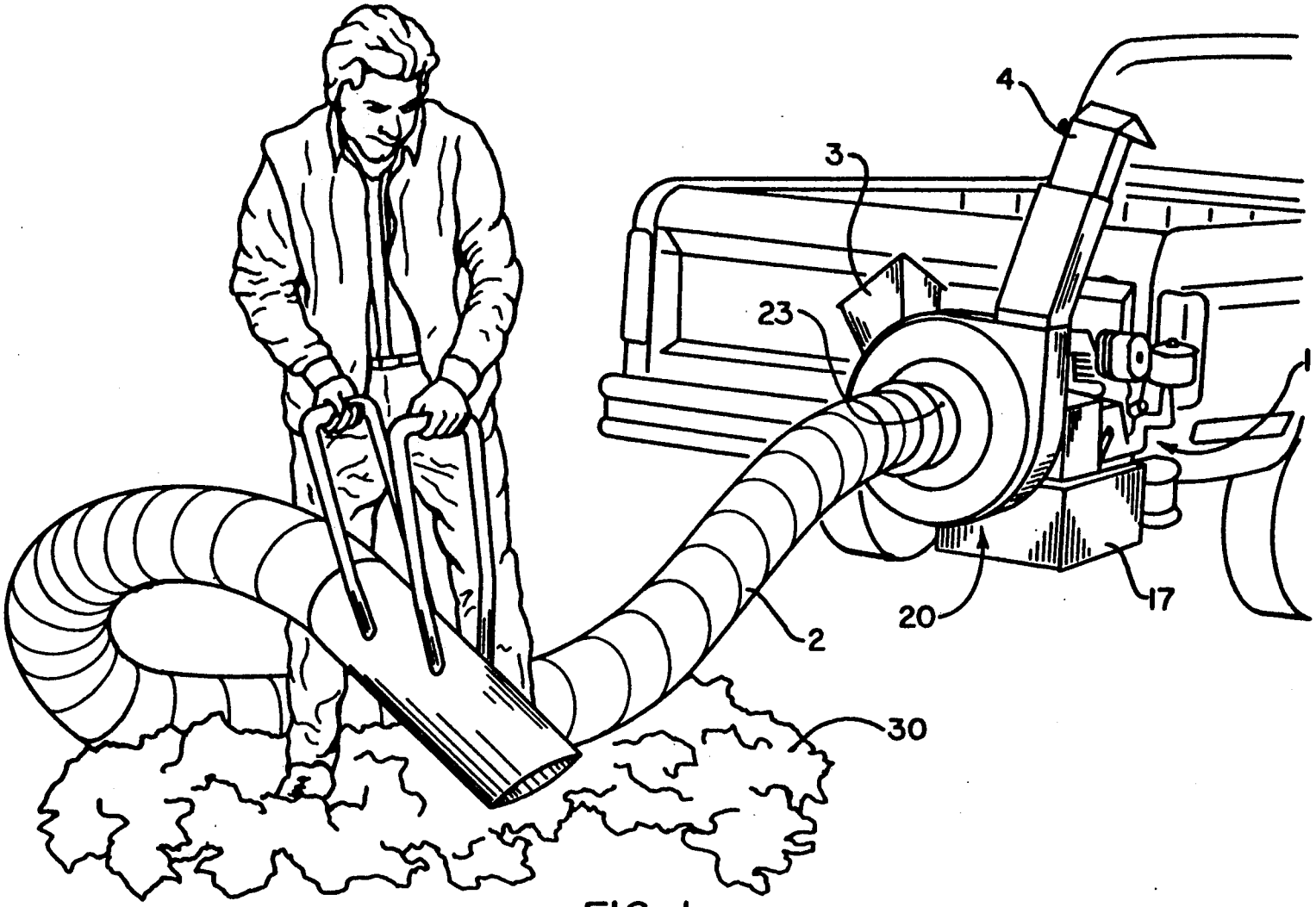
FIG. 1 is a perspective of the preferred embodiment of the present invention showing the apparatus attached to a pickup truck.

FIG. 1 shows the preferred embodiment of the comminuting vacuum and wood chipper or reducer vacuum 20. The reducer vacuum 20 is shown mounted to the rear bumper of a pickup truck.

Figure 2:
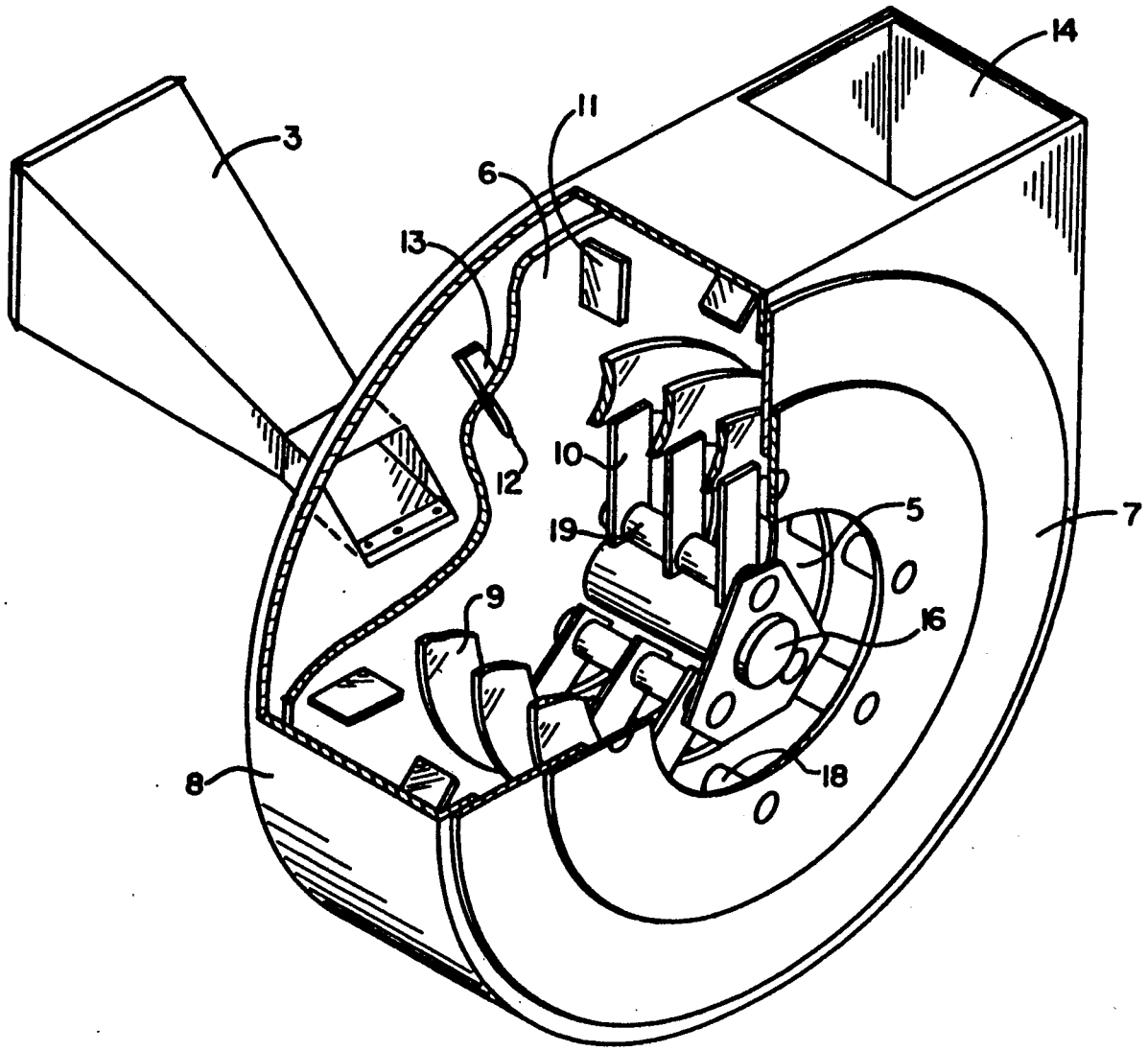
FIG. 2 is a perspective view of the present invention without its engine, vacuum hose or mounting bracket with a partial cutaway of the exterior housing.

A conventional internal combustion engine 1 provides power to the reducer vacuum 20. Typically, a five to eleven horsepower gasoline engine is used. Referring to FIG. 2, the power of the engine 1 is applied through a series of pulleys and belts (not shown) to a main shaft 16. The main shaft 16 is connected to a flywheel or disk 6 which has a slot 12 for wood chips and a chipping blade 13 along with a plurality of fan blades 11 mounted to it. The flywheel 6 is enclosed by a housing 8 and reducing chamber cover 7. the flywheel 6 is mounted on the shaft 16 so that a small space exists (about one inch) between the back wall of the flywheel 6 and the back wall of the enclosure 8.

A plurality of free swinging hammers 10 are attached to the shaft 16 and the flywheel 6. Spacers 19 are provided to maintain the free swinging hammers 10 parallel to the flywheel 6.

The preferred embodiment discloses a plurality of circular grate bars 9 attached to the cover 7. The circular grate bars 9 are spaced apart by a series of spacers 18 such that the circular grate bars 9 are maintained parallel to the cover 7, flywheel 6 and the free swinging hammers 10. The ends of the free swinging hammers 10 extend into the circular grate bars 9. The spacers 18 and spacers 19 are sized and placed so that the free swinging hammers 10 can rotate between the circular grate bars 9 without impacting the bars 9 or spacers 18. This area, which contains the free swinging hammers 10 and the circular grate bars 9, is the reducing chamber 5.

Grate bars 9 serve to provide a medium through which the hammers 10 drive the debris in order to reduce the size of this debris. While the grate bars 9 in the preferred embodiment are disclosed as being circular and therefore surrounding the hammers 10, a number of various hammer/grate orientations are contemplated. A principle consideration is that the grate bars 9 are located between the hammers 10 and the discharge opening and in close proximity to the hammers so that the hammers can direct the debris against the grate bars 9 with sufficient force to comminute this debris into a size which can pass through the area between the grate bars, when the debris will be drawn out and expelled by the vacuum force within the chamber.

Figure 5:
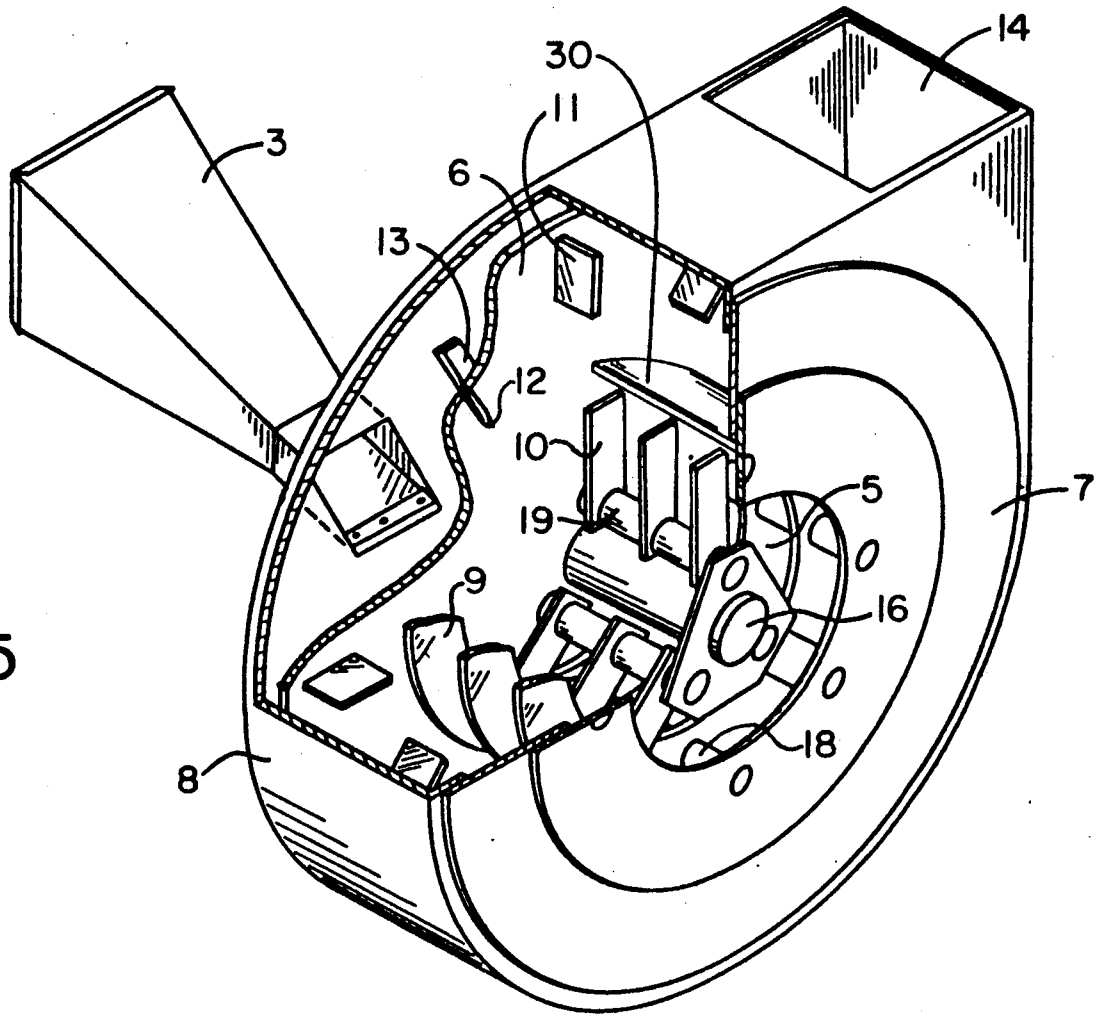
FIG. 5 is a perspective view of the present invention without its engine, vacuum hose, or mounting brackets with a partial cutaway of the exterior housing and illustrating an alternative embodiment of the reducing chamber and grate bars.
Figure 6:
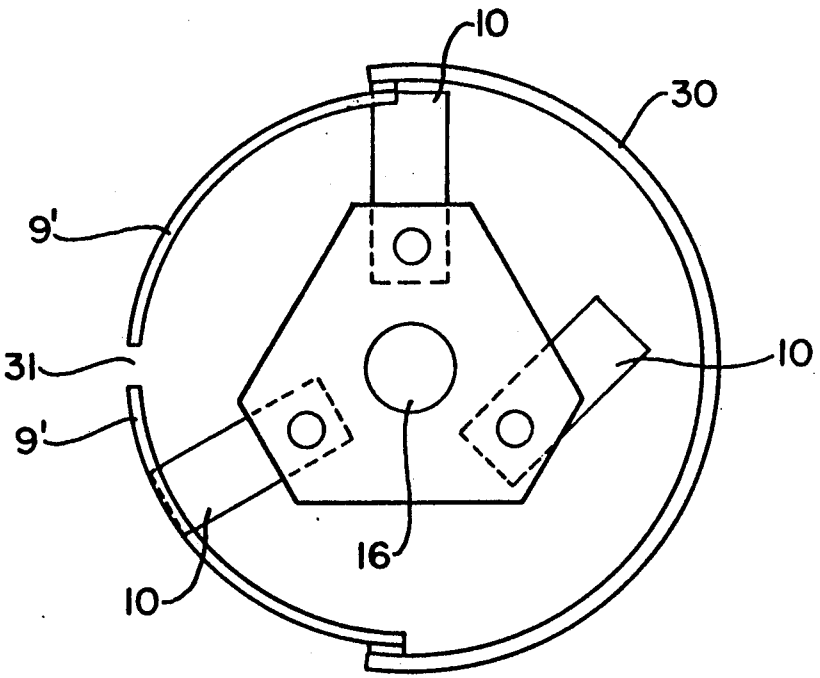
FIG. 6 is a side plan view, with the exterior housing removed for purposes of illustration, and illustrating an alterative embodiment of the reducing chamber and grate bars.

While preferred, it is not required that the grate bars 9 be circular or that the same totally surrounds the hammers. As shown in FIGS. 5 and 6, a reducing chamber 5 wherein a plurality of grate bars comprise one or more partial arcs in the total area surrounding the hammers 10 is contemplated. The remainder of the chamber 5 is formed by a solid wall or enclosure 30. Such an embodiment is desirable in order to concentrate the vacuum in a smaller area. Additionally, reducing chamber 5 can take on virtually any closed cylindrical shape.

Figure 7:
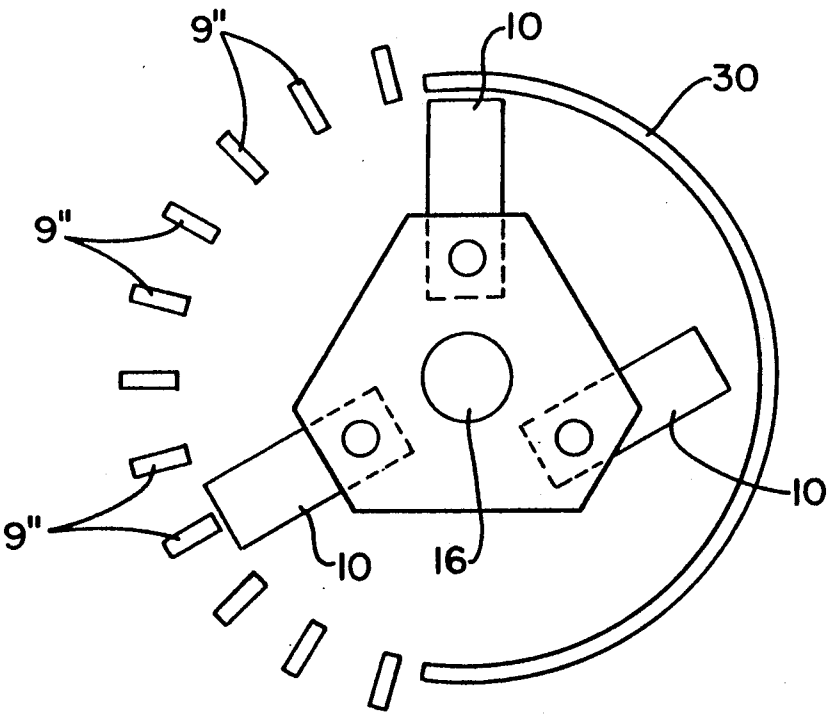
FIG. 7 is a side plan view, with the exterior housing removed for purposes of illustration and illustrating still another embodiment of the reducing chamber and grate bars.

Similarly, while an embodiment having hammers 10 which extend into the space created between adjacent grate bars 9 is preferred and aids in the purging of material from between the bars, a device in which the grate bars merely approximate the path of the hammers' distal end is also contemplated. This allows for grate bars which are positioned other than parallel to the hammers 10 or the housing cover 7. One such embodiment is illustrated in FIG. 7. Such an embodiment may be desirable in instances where the purging function of the hammers is not critical and the vacuum force is sufficient to obviate such purging. Grate bars 9, positioned other than parallel to either the housing cover 7 or the hammers 10, create a beneficial shear action between the hammers 10 and the inner surface of each grate bar 9 to comminute the debris. This shear action can be achieved by grate bars 9 which are positioned perpendicular or at angles to the housing cover 7 or hammers 10. This embodiment provides added safety to the operator, making it more difficult for accidental contact with the rotating hammers 10. Furthermore, if discharge is directed toward the ground, the necessity of a discharge chute to direct the exiting debris may be eliminated.

Additionally, any arcs formed by grate bars 9 circumscribing a portion of the area around said hammers can be discontinuous as shown in FIG. 6 with bars 9 in the same plane having a gap 31 no wider than the greatest width between two adjacent grate bars.

A vacuum hose 2 is connected to an inlet housing 23 on the reducer vacuum 20.

When the reducer vacuum 20 is operated, the fan blades 11 exhaust the air from inside the housing 8 through an exhaust outlet 14 and into a discharge chute 4. The discharge chute 4 can be positioned so that the reduced leaves and wood chips can be directed to all parts of the pickup truck bed. The exhausting of the air causes a vacuum or suction in the reducing chamber. The resulting vacuum is sufficient to vacuum leaves and other lawn debris 30 through the vacuum hose 2 into the reducing chamber 5. The vacuum caused by the fan blades 11 pulls the reduced debris through the circular grate bars 9 and increases the rate at which lead, garden and lawn debris 30 can be processed.

Any leaf, garden and lawn debris 30 that enters the reducing chamber 5 must pass through the circular grate bars 9 in order to be exhausted out of the vacuum reducer 20. As the leaf, garden and lawn debris 30 passes through the circular grate bars 9, the free swinging hammers 10 impact the leaf, garden and lawn debris 30 against the bars 9 and reduce the debris to small particles. Typically, leaf, garden and lawn debris 30 is reduced to particles which will pass through a one-half inch to three quarters inch screen.

In the preferred embodiment, the free swinging hammers 10 extend into the circular grate bars 9 in order to improve the efficiency of the leaf, garden and lawn debris reduction. This extension of the hammers 10 also helps prevent the leaf, garden and lawn debris 30 from building up in layers on the inner radius of the circular grate bars 9. In the event the leaf, garden and lawn debris 30 builds up on the bars 9, vacuum decreases until it is no longer sufficient to suction up leaf, garden and lawn debris 30. At this point, the machine would be shut down and the circular grate bars 9 manually cleaned. Extending the hammer bars 10 into the circular grate bars 9 prevents this buildup.

Sometimes small twigs, bark and even metal objects such as soft drink cans will be vacuumed into the reducing chamber 5. If the object is large than the gap between the circular grate bars 9, it can become stuck on the bars. If the hammers 10 were rigidly fixed to the shaft 16 of flywheel 6, the hammers 10 could become stuck with the debris and stall the vacuum reducer 20 and the engine 1. Since the hammers 10 are free swinging, they will impact a stuck object and swing back in order to pass by the stuck object. Repeated impacts against such a stuck object will eventually reduce its size until it can pass through the circular grate bars 9 (for most objects including twigs, bark, metal cans, pine cones, etc.). Some objects, such as stones will not be reduced. However, the free swinging hammers 10 will swing back and pass over the object rather than stalling the vacuum reducer 20 and the engine 1.

Because some of the leaf, garden and lawn debris 30 will consist of stones and metal objects, the free swinging hammers 10 are hardened steel in order to resist damage when impacting hard objects. The free swinging hammers 10 are designed to facilitate replacement in the event a hammer is damaged.

After the lawn and leaf debris 30 is reduced, it passes through the circular grate bars 9 into the fan area of the reducer vacuum 20. The fan blades 11 exhaust the reduced debris through the exhaust outlet 14 and into the discharge chute 4. The discharge chute 4 is adjustable so that the discharge can be directed to all parts of the bed of the pickup truck in order to evenly and completely fill the truck without manually redistributing the reduced debris.

In addition to vacuuming and reducing lawn and leaf debris, the reducer vacuum 20 will chip small limbs and branches. A chipping blade 13 is located on the reverse side of the flywheel 6. Limbs and branches up to three inches in diameter can be fed to the chipping blade 13 through a limb chute 3 which is located on the back side of the housing 8. The limb chute 3 and the chipping blade 13 are located on the backside of the flywheel 6 so that the chips from the limbs and branches can pass through a slot 12 in the flywheel 6 and into the main chamber inside the housing 8 where the chips are exhausted along with the reduced debris through exhaust outlet 14.

The flow of air out through the exhaust outlet 14 will cause a slight reduction in pressure and a small flow of air from the region between the flywheel 6 and the back wall of the housing 8. This slight air flow will sweep out any wood chips that do not pass through slot 12 and prevent a build up chips and other debris behind the flywheel 6. Keeping the distance between the flywheel 6 and the back wall of the housing 8 small will facilitate this effect.

The mounting bracket 17 permits the reducer vacuum 20 to be swung away from the tail gate of the pickup truck. To provide easier access to the limb chute 3, the reducer vacuum 20 is swung out to 45°. The reducer vacuum 20 also swings out 90° so that the apparatus is clear from the pickup truck in order to allow the tail gate to be opened in the conventional manner.

Figure 4:
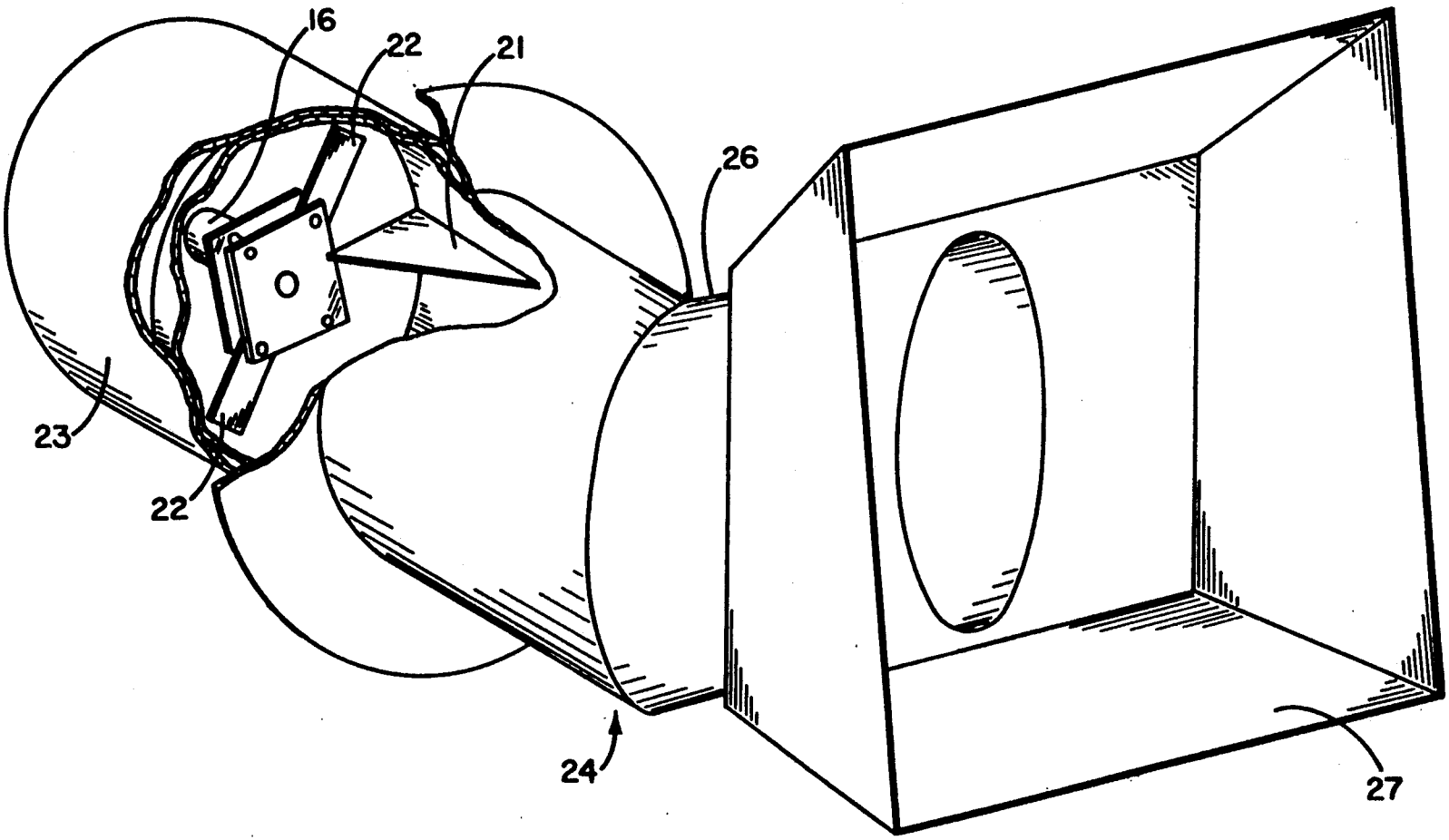
FIG. 4 is a perspective view of the feeder intake chute with a partial cutaway of the exterior housing.

The reducer vacuum 20 can be used with a loading hopper or a vacuum snout in place of the vacuum hose 2. The loading hopper can be of conventional design (not shown) or it can be a feeder intake chute 24 as shown in FIG. 4. It can be mounted on a trailer frame for towing rather than directly to the truck. The reducer vacuum 20 can be mounted on wheels with a vacuum snout and a bag or container for collecting the reduced debris.

The reducer vacuum 20 can also be used for shredding and blowing straw to cover newly planted lawns. It can also spread various types of mulches. If used when cleaning horse stalls, a mix of straw and horse manure is produced which can be used as an organic fertilizer.

Figure 3:
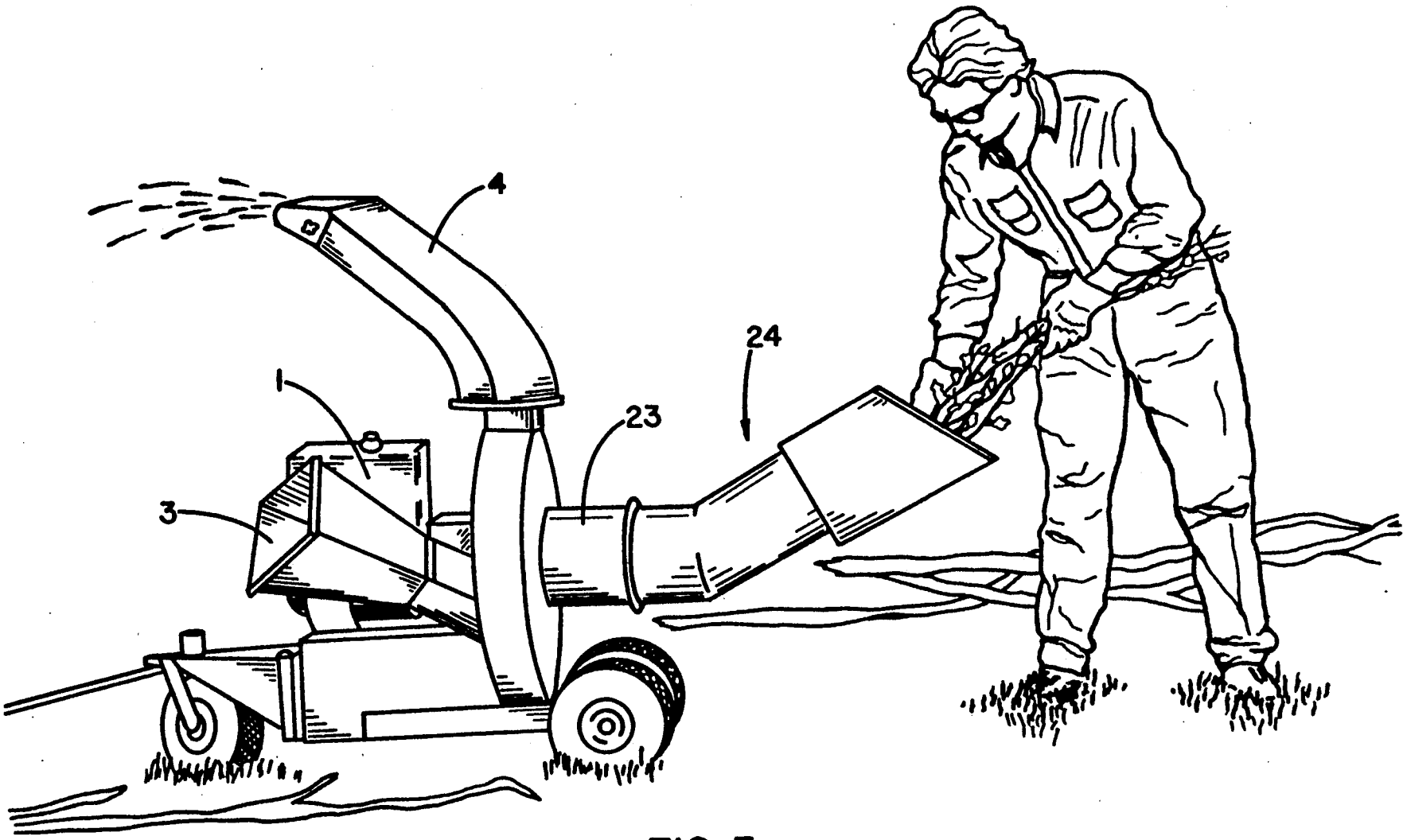
FIG. 3 is a perspective view of the reduces vacuum mounted on wheels with the feeder intake chute attached.

An alternate configuration of the reducer vacuum, shown in FIGS. 3 and 4, adds a feeder intake chute 24 which is designed to pull small limbs, branches and saplings into the reducing chamber 5. The feeder intake chute 24 attaches to the inlet housing 23 in place of a vacuum hose 2 or a vacuum snout (not shown). The feeder intake chute 24 can be used with the pickup truck configuration shown in FIG. 1, or the trailer mounted configuration as shown in FIG. 3.

A feeder intake chute 24 used with the reducer vacuum 20 can achieve material feed rates in excess of one foot per second.

The feeder intake chute 24 is a conventional loading hopper with internal cutting blades 22 and an internal baffle plate 21. The feeder intake chute 24 consists of an inlet hopper 27 and a feeder intake chute housing 26. The feeder intake housing 24 length and shape is designed to prevent the operator's hand and arm from reaching any rotating components.

The cutting blades 22 are free swinging hardened steel blades which are attached to the shaft 16. Attached to the inside circumference of the feeder intake chute housing 26 is a baffle plate 21. The baffle plate 21 extends away from the housing wall at an 80° angle. The baffle plate 21 angled towards the rotating cutting blades 22. The trailing edge of the baffle plate 21 is approximately 0.75 inches from the cutting blades 22.

If the baffle plate 21 is located closer to the cutting blades 22, the feed material, small limbs, branches and saplings, is cut with very little vibration, but with a decrease in pulling rate. If the baffle plate 21 is located further from the cutting blades 22, the feed material is pulled into the cutting blades 22 at a faster rate, but with greater vibration.

When the feed material is pushed past the baffle plate 21 and into the region of the cutting blades 22, the rotating cutting blades impinge on the feed material, grabbing the material, and pulling it into the feeder intake chute 24. The cutting blades 22 also cut the feed material into pieces two to three inches long. The vacuum in the reducing chamber 5 then pulls these pieces into the reducing chamber where the free swinging hammers 10 and circular grate bars 9 will comminute the pieces into small fragments. The majority of the volume reduction takes place in the reducing chamber 5 and not in the feeder intake chute 24.

Cutting blades 22 may or may not have one or more sharpened edges as the cutting blades 22 principal function is to serve as hammers which cooperate with the baffle plate 21 to pull the feed material into the comminutor. Cutting blades 22 secondary function is to cut the feed material as it is pulled into the comminutor. If the cutting blades 22 principal function were to cut the feed material its action would be similar to the chipper blade 13 attached to the disc of the present invention.

The baffle plate 21 also prevents the feed material from rotating when the rotating cutting blades 22 impact the feed material. If the material rotated, no or very little cutting would occur. The feed material would bunch up rather than be vacuumed into the reducing chamber 5.

The feeder intake chute 24 can be used with conventional reducing machines or conventional lawn and garden debris vacuum machines. The cutting blades 22 could be directly mounted to the reducing machine or vacuum machine main shaft where possible. In some cases, an auxiliary shaft (not shown) would be needed as would be driven by belts or gears from the machine's engine.

The preferred embodiment discloses a shaft of the feeder intake chute which rotates around a horizontal axis. However, it is contemplated that a shaft rotating about an axis other than horizontal may be desired. For instance, a feeder intake chute 24 used with the reducer vacuum mounted on a chassis can have a shaft that rotates at an angle above horizontal to allow the operator to feed debris into the chute from a more upright posture. On the other hand, a reducer vacuum mounted on a truck or other motor vehicle may require a rotation axis below horizontal for easy feeding by the operator from the ground. Such changes to the rotational axis of a rotatable shaft are well known in the art.

The feeder intake chamber 24 with the reducer vacuum 20 reduces small limbs, branches and saplings faster than a reducer vacuum 20 can when the limb chute is used. Additionally, the efficiency of the reducer vacuum 20 is increased because the small limbs, branches and saplings are fed into the reducing chamber 5 in large quantities of pieces two to three inches long, rather than being chipped by the chipping blade 3 one or two limbs or saplings at a time.

Basically, the prior art devices rely on vacuum or manual feeding to pull material into the machine. The Martison device, U.S. Pat. No. 3,688,479, uses a rotating brush to sweep material into the suction of the device. None of the feed mechanisms in these prior art vacuums or comminutors will pull small limbs, branches and saplings into the machines.

While in accordance with the patent statutes, the best mode and preferred embodiment of the invention have been described, it is to be understood that the invention is not limited thereto, but rather is to be measured by the scope and spirit of the appended claims.

What is claimed is:

1. A reducing vacuum machine for debris having at least one inlet opening and one discharge opening comprising:

a) at least one housing;

b) a disc removably mounted in said at least one housing;

c) a plurality of hammers pivotally connected to said disc;

d) a plurality of grate bars enclosing at least a partial arc around said hammers and being in close proximity to the outer end of said hammers, such that said hammers force debris through said grate bars;

e) a plurality of fan blades attached to said disc;

f) a power means for rotating at least said disc.

2. A reducer vacuum machine according to claim 1 wherein said grate bars are oriented essentially perpendicular to said hammers.

3. A reducer vacuum machine according to claim 1 wherein said grate bars are oriented essentially parallel to said hammers.

4. A reducer vacuum machine according to claim 3 wherein the outer end of said hammers extend into the space between adjacent grate bars.

5. A feeding apparatus for use with a comminuting machine having a power source, said feeding apparatus comprising:

a) a housing having at least one inlet opening and at least one outlet opening;

b) a means for removably attaching said housing to said comminuting machine such that said outlet opening operately connects with an inlet opening of said comminuting machine;

c) a shaft rotatably mounted in said housing;

d) a plurality of hammers pivotally mounted to said shaft;

e) a transmission means associated with said shaft and connectable to the power source on a comminuting machine;

f) at least one baffle plate mounted to an inside surface of said housing, said baffle plate being located between said hammers and said inlet opening such that said baffle plate cooperates with said hammers to pull feed material into said comminuting machine.

6. A feeding apparatus as recited in claim 5 wherein said hammers are parallel to a trailing edge of said baffle plate.

7. A feeding apparatus as recited in claim 5 wherein a trailing edge of said baffle plate is located about 0.5 to 1.0 inches from said hammers.

8. A feeding apparatus as recited in claim 5 wherein at least one said hammer has at least one sharpened edge.

9. A feeding apparatus as recited in claim 5 wherein the axis of rotation of said shaft is non-vertical.

10. A feeding apparatus as recited in claim 9 wherein the axis of rotation of said shaft ranges from about 60° above horizontal to about 60° below horizontal.

11. A feeding apparatus in combination with a comminuting machine, comprising:

a) a comminuting machine having a power source;

b) a housing connected to said comminuting machine;

c) a shaft rotatably mounted in said housing;

d) a plurality of hammers pivotally mounted to said shaft;

e) a transmission means connecting said shaft to said power source on said comminuting machine; and f) at least one baffle plate mounted to an inside surface of said housing, said baffle plate being located between said hammers and said inlet opening such that said baffle plate cooperates with said hammers to pull feed material into said comminuting machine.

12. A feeding apparatus as recited in claim 11 wherein said hammers are parallel to a trailing edge of said baffle plate.

13. A feeding apparatus as recited in claim 11 wherein a trailing edge of said baffle plate is located about 0.5 to about 1.0 inches from said hammers.

14. A feeding apparatus as recited in claim 11 wherein at least one said hammer has at least one sharpened edge.

15. A feeding apparatus as recited in claim 11 wherein the axis of rotation of said shaft is non-vertical.

16. A feeding apparatus as recited in claim 15 wherein the axis of rotation of said shaft ranges from about 60° above horizontal to about 60° below horizontal.

17. Apparatus for comminuting organic material comprising:

a housing defining a comminuting chamber, said housing having a pair of spaced end walls and a curved wall connecting said end walls, one of said end walls having an inlet opening into said chamber, said curved wall cooperating with said end walls to form an outlet from said chamber, a plurality of hammers pivotally mounted for rotation in a circular path of motion in said chamber, a drive shaft extending into said chamber for rotating said hammers, means located adjacent said other end wall mounting a plurality of fan blades for rotation in said chamber in a circular path of motion surrounding said path of motion of said hammers, a series of grate bars extending at least partially around the path of motion of the hammers in the region of the outlet from the chamber, and means mounting said grate bars to said one end wall containing said inlet to said chamber, whereby rotation of the drive shaft causes the fan blades to draw materials into the inlet and to displace the materials across the grate bars through the chamber outlet.

18. Apparatus for comminuting organic material, comprising:

means defining a comminuting chamber having an inlet for admission of material to be comminuted and an outlet for discharge of comminuted materials, a plurality of hammers mounted in said chamber for rotation in a path around said inlet for comminuting materials in said chamber, said chamber outlet being disposed substantially tangential to the path of movement of said hammers in said chamber, and means providing a plurality of fan blades rotatable in said chamber on the same axis in a path radially outwardly of the center of rotation of said hammers for drawing organic material axially into said chamber through said inlet and displacing said organic material radially outward through the hammers for discharge through said outlet in response to rotation of said hammers and said fan blades in said chamber, a plurality of grate bars extending at least partially about the periphery of the path of movement of the hammers and inwardly of the path of movement of said fan blades for cooperating with said hammers to comminute materials in said chamber, whereby materials can be continually comminuted in the chamber.

19. Apparatus according to claim 18 including means extending into said chamber for driving both said fan blades and said hammers simultaneously about a common axis.

20. Apparatus according to claim 18 wherein said grate bars extend at least in the region of said chamber outlet.

21. Apparatus according to claim 20 wherein said grate bars extend in spaced parallel relation along opposite sides of the path of motion of each of the hammers as it advances in the chamber.

22. Apparatus according to claim 21 wherein said grate bars overlap said hammers adjacent their outer extremities when in motion.

23. Apparatus according to claim 21 wherein said grate bars are disposed closely adjacent to the outer extremities of the hammers when in motion.

24. Apparatus according to claim 23 wherein said grate bars extend in spaced parallel relation in an arcuate pattern about the periphery of the hammers at least in a zone adjacent said outlet.

25. Apparatus according to claim 17 including means for driving said fan blades and hammers simultaneously in their respective paths of motion, said driving means including a drive shaft extending into said chamber, a disk connected to said drive shaft for mounting said fan blades, means for pivotally connecting said hammers to said drive shaft, and including a plurality of grate bars mounted in said chamber between the path of motion of said hammers and the path of motion of said fan blades.

26. Apparatus according to claim 25 wherein said chamber defining means includes a pair of end walls spaced apart axially, one of said end walls having said inlet formed therein and the other of said end walls being disposed closely adjacent to said fan blade mounting disk.

27. Apparatus according to claim 26 wherein said grate bars are mounted to said one end wall and said fan blades extend into said chamber from a location on said disk adjacent to said other end wall.

* * * * *